US006862986B2

(12) United States Patent
Kersch et al.

(10) Patent No.: US 6,862,986 B2
(45) Date of Patent: Mar. 8, 2005

(54) APPARATUS FOR SETTING THE LATERAL REGISTER FOR PRINTING UNITS OF ROTARY PRESSES

(75) Inventors: Robert Kersch, Augsburg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 3 days.

(21) Appl. No.: 10/619,996

(22) Filed: Jul. 15, 2003

(65) Prior Publication Data

US 2004/0144273 A1 Jul. 29, 2004

(30) Foreign Application Priority Data

Jul. 16, 2002 (DE) ..... 102 32 026

(51) Int. Cl.[7] ..... B41F 13/24; B41F 13/12; B41F 1/34; B41F 13/00

(52) U.S. Cl. ..... 101/248; 101/485; 101/486; 101/171; 101/174; 101/178

(58) Field of Search ..... 101/248, 485, 101/486, 171, 174, 178, 425, 179, 180, 375, 216, 247

(56) References Cited

U.S. PATENT DOCUMENTS

| | | | | | |
|---|---|---|---|---|---|
| 3,750,568 | A | * | 8/1973 | Weisgerber | 101/248 |
| 3,963,902 | A | * | 6/1976 | Dowd | 377/17 |
| 4,137,845 | A | * | 2/1979 | Jeschke | 101/248 |
| 4,177,730 | A | * | 12/1979 | Schriber et al. | 101/248 |
| 4,301,470 | A | * | 11/1981 | Pagany | 348/95 |
| 4,369,705 | A | * | 1/1983 | Gelinas | 101/177 |
| 4,512,256 | A | * | 4/1985 | Schriber et al. | 101/248 |
| 4,572,074 | A | * | 2/1986 | Guaraldi | 101/484 |
| 4,756,247 | A | * | 7/1988 | Schwartz et al. | 101/177 |
| 4,794,453 | A | * | 12/1988 | Gnuechtel et al. | 348/88 |
| 4,887,530 | A | * | 12/1989 | Sainio | 101/181 |
| 4,932,320 | A | * | 6/1990 | Brunetti et al. | 101/181 |
| 4,960,048 | A | * | 10/1990 | Sarda | 101/182 |
| 5,067,403 | A | * | 11/1991 | Massierer | 101/248 |
| 5,239,924 | A | * | 8/1993 | Wallmann et al. | 101/179 |
| 5,255,598 | A | * | 10/1993 | van Sas et al. | 101/118 |
| 5,265,529 | A | * | 11/1993 | Tafel | 101/218 |
| 5,311,817 | A | * | 5/1994 | Funada | 101/177 |
| 5,327,826 | A | * | 7/1994 | Rodi | 101/181 |
| 5,377,590 | A | * | 1/1995 | Bolza-Schunemann et al. | 101/389.1 |
| 5,553,537 | A | * | 9/1996 | Hara | 101/116 |
| 5,771,804 | A | * | 6/1998 | Knauer et al. | 101/183 |
| 5,782,182 | A | * | 7/1998 | Ruckmann et al. | 101/177 |
| 5,806,431 | A | * | 9/1998 | Muth | 101/486 |
| 5,913,267 | A | * | 6/1999 | Britsch | 101/401.1 |
| 6,026,172 | A | * | 2/2000 | Lewis et al. | 382/106 |
| 6,085,658 | A | * | 7/2000 | Goldstein | 101/486 |
| 6,119,594 | A | * | 9/2000 | Kipphan et al. | 101/365 |
| 6,334,389 | B1 | * | 1/2002 | Fischer | 101/216 |
| 6,397,743 | B1 | * | 6/2002 | Dauer et al. | 101/220 |
| 6,502,509 | B2 | | 1/2003 | Göttling et al. | 101/248 |
| 6,591,746 | B2 | * | 7/2003 | Siler | 101/171 |
| 6,651,557 | B1 | * | 11/2003 | Costin et al. | 101/218 |

FOREIGN PATENT DOCUMENTS

| | | |
|---|---|---|
| DE | 39 33 666 C2 | 6/1993 |

* cited by examiner

*Primary Examiner*—Andrew H. Hirshfeld
*Assistant Examiner*—Wasseem H. Hamdan
(74) *Attorney, Agent, or Firm*—Cohen, Pontani, Lieberman & Pavane

(57) ABSTRACT

An apparatus for setting the lateral register of a printing unit of a rotary press that prints on a paper web includes a first bearing block configured as a locating bearing arranged on the drive side of a forme cylinder; and a second bearing block configured as a floating bearing on the operating side of the forme cylinder. A pressure medium operated operating cylinder displaces the first bearing block axially and presses it against an adjustable stop without play for the purpose of setting the lateral register. A controller controls the axial location of the adjustable stop in at least one of a closed-loop fashion and an open-loop fashion based on register deviations determined by a scanning optics unit.

9 Claims, 6 Drawing Sheets

APPARATUS FOR SETTING THE LATERAL REGISTER FOR PRINTING UNITS OF ROTARY PRESSES

BACKGROUND OF THE INVENTION

1. Field of the Invention

The invention relates to an apparatus for setting the lateral register for printing units of rotary presses for printing a paper web, having at least one forme cylinder arranged, on the drive side, on a first bearing block which is axially movable and configured as a locating bearing, and arranged, on the operating side on a second bearing block which is configured as a floating bearing.

2. Description of the Related Art

When printing multicolor products with, as is known in the art, more than one printing unit, it is important for the individual printed images to lie one on top of another coincidentally. While the "circumferential register" is controlled via the drive of the forme cylinders, the lateral register is corrected by axially displacing the forme cylinder.

U.S. Pat. No. 6,502,509, the disclosure of which is hereby incorporated by reference, discloses an apparatus that displaces the bearing block of the forme cylinder. The bearing block is mounted on a longitudinal guide, with the aid of a controlled axis in order to set the lateral register. These controlled axes are known to be very complicated and expensive.

SUMMARY OF THE INVENTION

The object of the present invention to provide a simple but nevertheless accurate actuating apparatus that permits a rapid relatively large axial movement of the forme cylinder for decoupling purposes.

According to the present invention, a pressure medium operated cylinder displaces the first bearing block axially and presses it against a stop without play for the purpose of setting the lateral register. A controller controls the axial position of the stop based on register deviations detected by a scanning optics unit which scans the web.

It is advantageous to avoid a controlled axis, as a result of which the costs are considerably reduced. A rapid coupling movement of the forme cylinder in the axial direction is nevertheless possible.

It is important that a rapid coupling movement of the impression cylinder or forme cylinder can be carried out by means of the pressure-medium-operated operating cylinder. In particular, the impression cylinder or forme cylinder can be positioned laterally in-register rapidly by means of the adjustable stop. Thus, a rapid coupling movement and rapid laterally in-register positioning of the impression cylinder or forme cylinder is realized with the invention, i.e. the advantages of a rapid coupling movement by means of a pressure-medium-operated operating cylinder are combined with the advantages of rapid displacement into a laterally in-register position by means of the adjustable stop. As a result of the setting pressure of the pressure-medium-operated operating cylinder against the stop, this is without play, i.e. the bearing block rests against the adjustable stop without play as a result of the setting pressure of the pressure-medium-operated operating cylinder. The forme cylinder is displaced over its bearing blocks as a result of the adjustable stop and the lateral register is thus controlled with the adjustable stop and with the aid of a controller and a scanning-optics unit in the form of a camera. During the coupling movement, the pressure-medium-operated operating cylinder displaces the forme cylinder via the mounting on the drive side.

By means of the apparatus according to the invention, the previously set positions of the axial register or lateral register remain preserved when the forme cylinder is decoupled, in contrast to an apparatus for setting the lateral register with a controlled axis. A controlled axis would, of course, have to move to the previously set completion of the coupling movement. This takes time and increases the time needed for coupling and precise positioning of the forme cylinder at preset positions.

A further disadvantage of the prior art is that the controlled axes move at a constant speed during the setting of the lateral register. The positioning speed in this case is selected to be low enough for any adverse phenomena in the printed image not to be discernible during continuously necessary positioning operations, i.e. corrections of the lateral register, during printing operation. At the beginning of printing operation, this leads to displacement distances which are often still comparatively large requiring a long time and leading to many bad printed copies that are created in the process.

It is important that a setting apparatus is provided by means of the apparatus according to the invention which permits rapid and simple setting of the lateral register.

The apparatus according to the present invention has a positioning drive which can carry out the positioning operations required for correcting the lateral register at different speeds and is thus capable of using relatively high positioning speeds for of large displacements. A high positioning speed is not more disadvantageous for the printed image as the printed copies have to be considered poor in the case of large register deviations. It is important, however, that the time for adjusting the register deviation, in particular for adjusting the deviation of the lateral register, is considerably shortened by a high positioning speed.

Furthermore, the positioning speed, which does not impair the printed image, is a function of the rotational speed of the plate cylinder. The faster the plate cylinder rotates, the faster the positioning operation may be carried out. The apparatus according to the present invention thus always makes use of positioning speeds related optimally to the current machine speed, whereas customary positioning systems always have to be designed for a certain cylinder rotational speed and then carry out positioning too rapidly at a lower cylinder rotational speed. This is important in the case of variable-format presses, as different plate-cylinder circumference at a constant maximum web speed require different plate-cylinder rotational speeds and otherwise the positioning operation does not take place at the optimum speed in the case of most of the cylinder circumferences.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
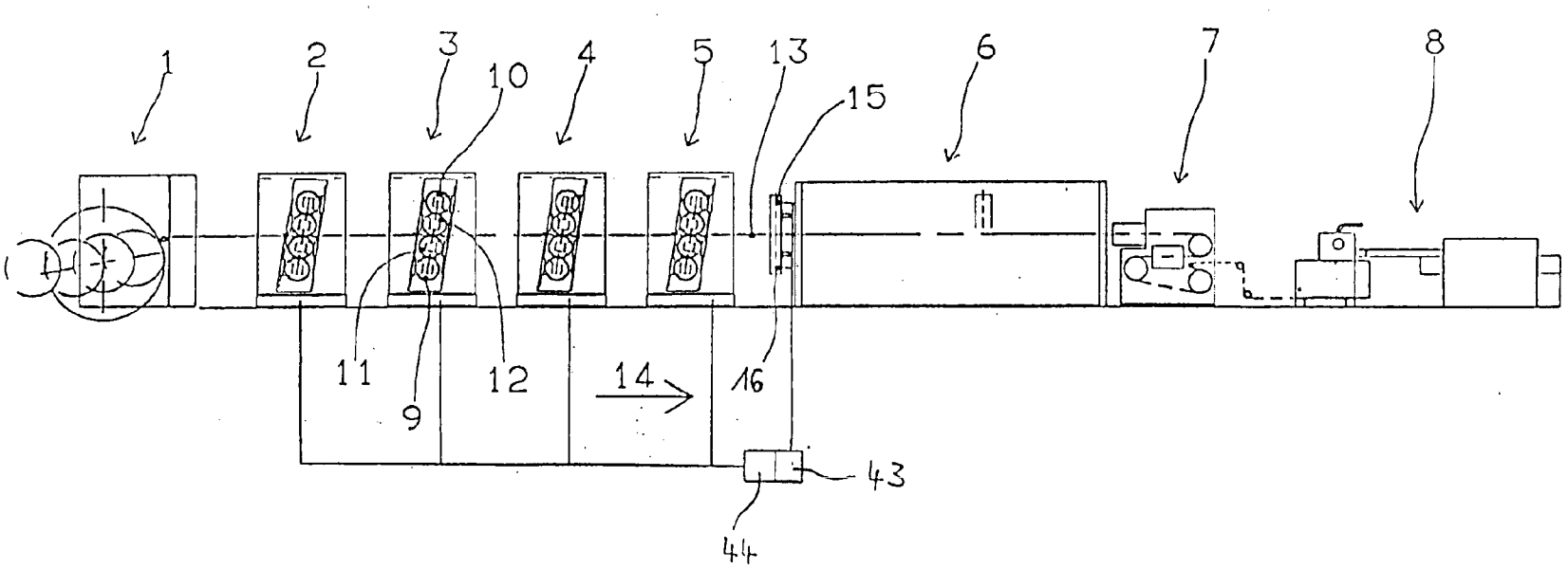
FIG. 1 is a schematic view of a four-color press having four double printing units.

FIG. 1 shows a press including a paper-reel changer 1, double printing units 2 to 5, a dryer 6, a cooling unit 7 and further processing means 8, for example a folder. Each of the double printing unit 2 to 5 has in each case two forme cylinders 9 and 10 and two transfer cylinders 11 and 12. The transfer cylinders 11, 12 transfer the inked printing image present on forme cylinders 9, 10 onto a paper web 13, which is thus printed on both sides with four colors as it passes in a direction 14.

As has already been mentioned, it is important when printing the paper web 13 that the four printed images in different colors lie one on top of another coincidentally. For this purpose, "register crosses" are transferred onto the paper web 13 along with the printed image by the forme cylinders 9, 10 via the transfer cylinders 11, 12. These register crosses from each printing unit 2 to 5 lie on top of one another coincidentally in the case of satisfactory printing. Deviations from coincidence are sensed by scanning-optics units 15, 16, for example cameras or register cameras, and converted using a controller 43 into control steps which are fed to a controller 44 for registration. Register adjustment at the circumference of forme cylinder 9, 10 takes place by means of the drive, in particular by means of individual drive motors; register adjustment of the forme cylinders 9, 10 in the axial direction, i.e. adjustment of the lateral register, will be explained in greater detail below.

Figure 2:
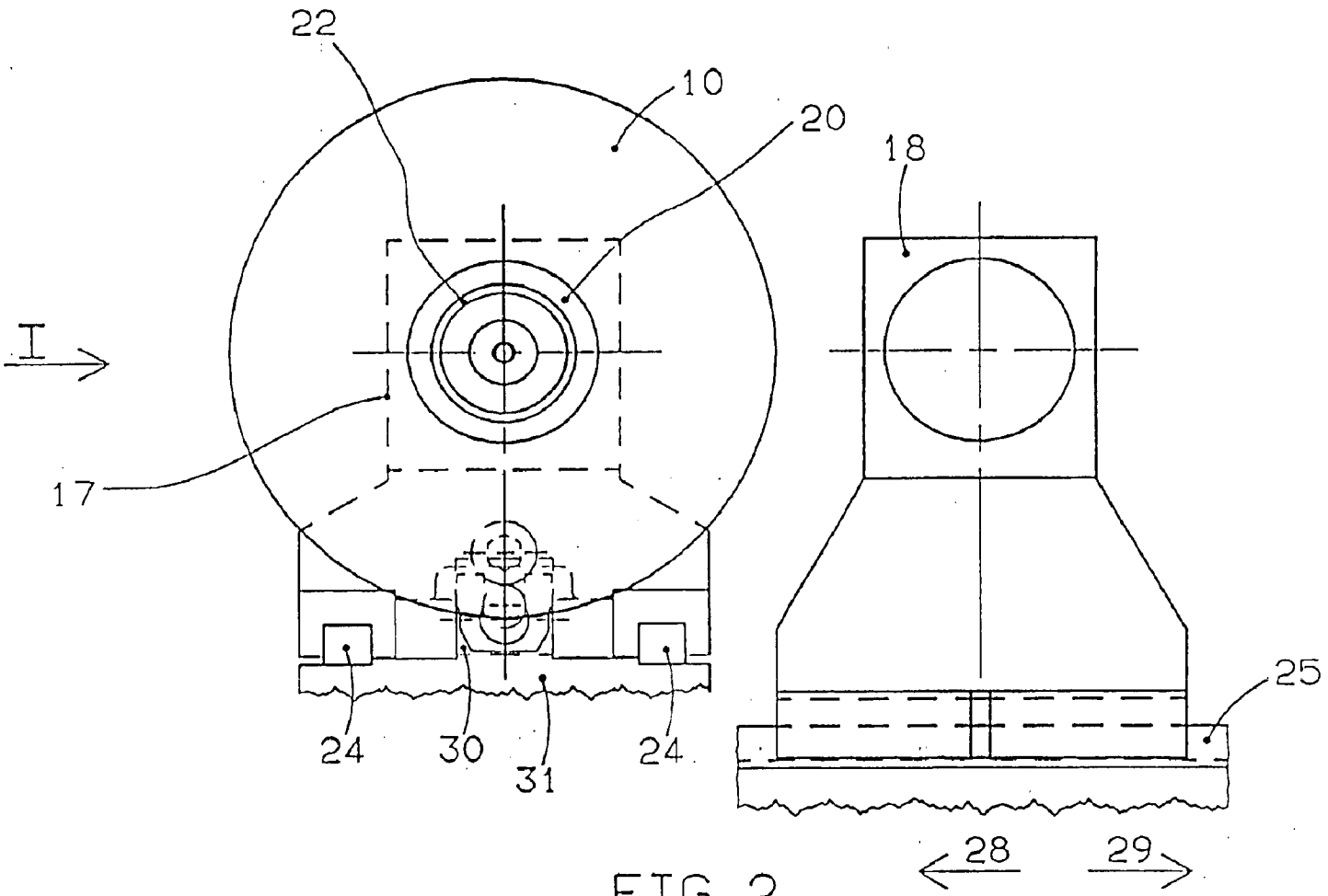
FIG. 2 is an end elevation view of a forme cylinder used in FIG. 1 in the decoupled state in one of the double printing units.
Figure 3:
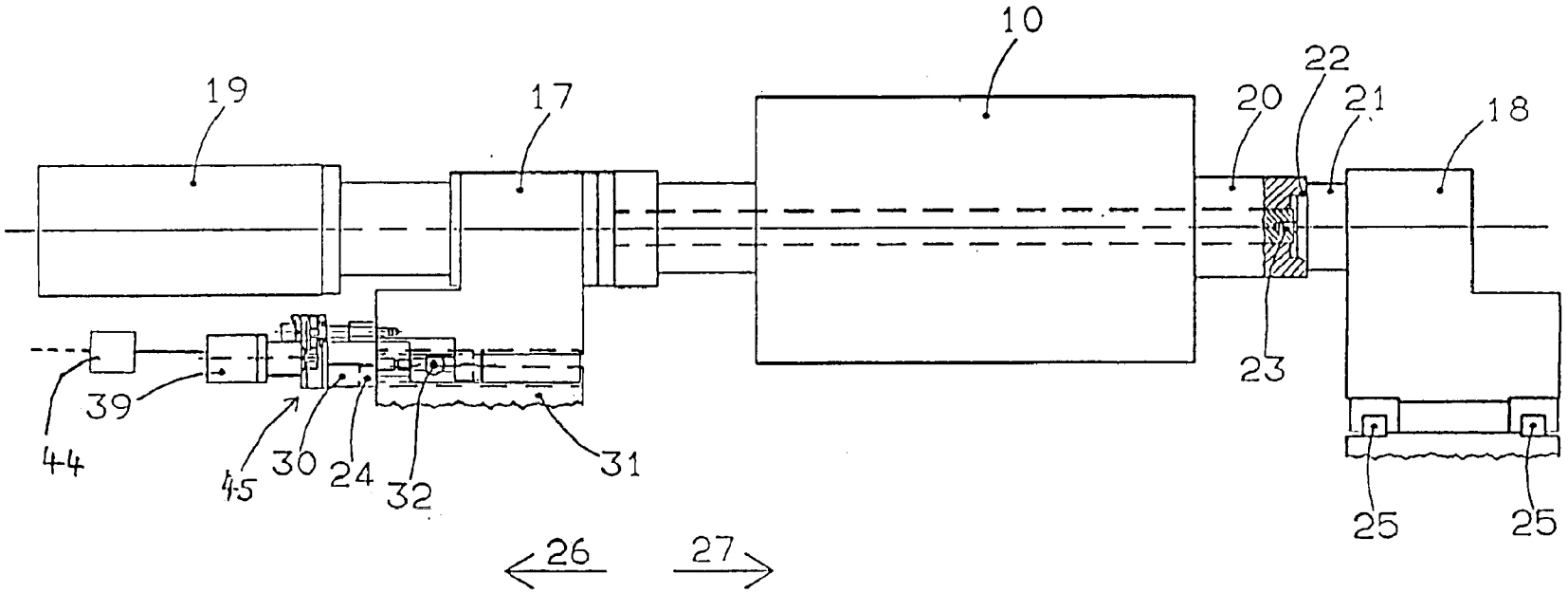
FIG. 3 is a side elevation view, in the direction I of FIG. 2, of a forme cylinder in the coupled state.

The construction of the forme cylinder mounting is shown in FIG. 2 and FIG. 3. The forme cylinder 10 is mounted in bearing blocks 17 and 18 so as to rotate and is driven by a drive 19, for example, an electric motor. The support of the cylinder on bearing block 18 between cylinder axle 20 and spindle axle 21 is released on a taper 22 using a screw connection 23.

As is shown, the bearing block 17 is mounted on guides 24, and the bearing block 18 is mounted on guides 25. In this way, the bearing block 17 can be displaced in a direction 26 or 27 and the bearing block 18 can be displaced in a direction 28 or 29. The bearing block 17 is configured as a locating bearing, and the bearing block 18 is configured as a floating bearing which permits a certain amount of displacement in directions 26 and 27. A pressure-medium-operated operating cylinder 30, for example, a pneumatic cylinder or hydraulic cylinder, is connected at one end to a stationary machine frame 31 and at the other end its piston rod is connected via a pivot bearing 32 to the bearing block 17.

Figure 4:
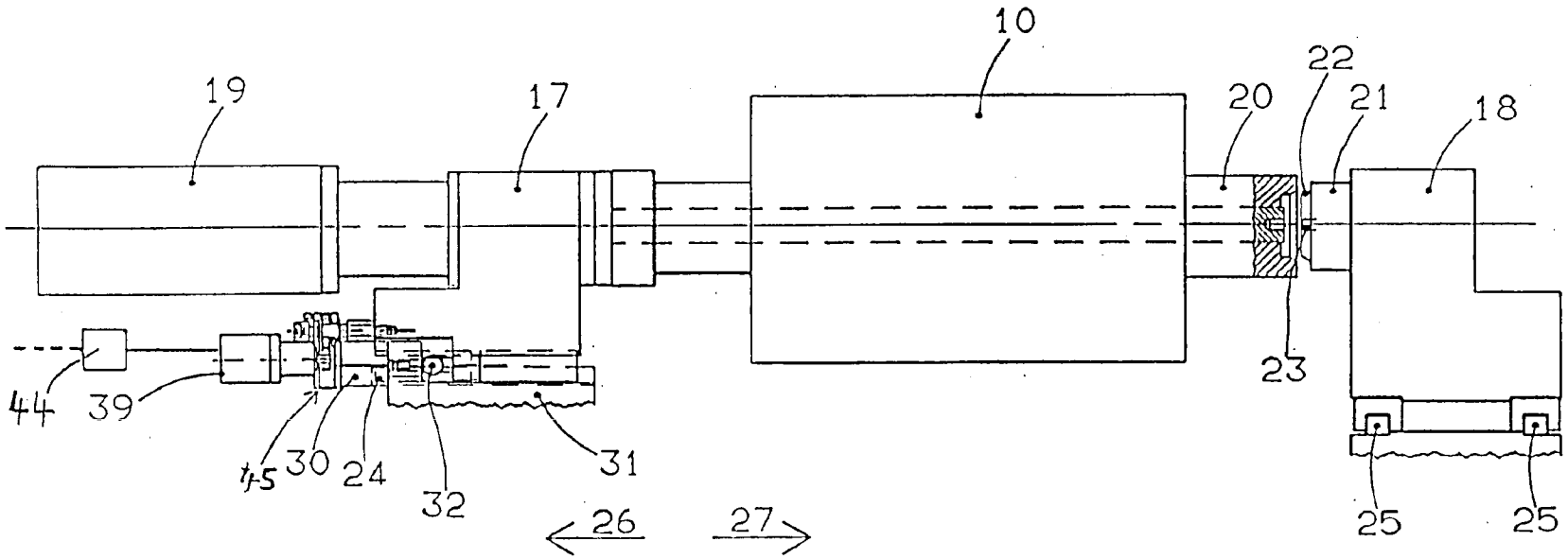
FIG. 4 is a side elevation view, in the direction I of FIG. 2, of a forme cylinder in the decoupled state.

In order to remove the forme cylinder 9, 10 or a form-cylinder sleeve from the surface of the forme cylinder 9, 10; the axle 20 of cylinder 9, 10 must be separated from the bearing block 18, as is known in the art. As shown in FIG. 4, the screw connection 23 is released and withdrawn for this purpose. The forme cylinder 9, 10 is then moved over bearing block 17 in direction 26 (throw-off or decoupling direction) by means of pressure-medium-operated operating cylinder 30 and is thus released from the taper 22. The cylinder 9, 10 thus now hangs freely on the bearing block 17 without the support of the bearing block 18. This bearing block 18 can now be moved in direction 29 by means of a drive (not shown here). In this way, the forme cylinder 9, 10 lies ready for removal in the axial direction or for removal of the form-cylinder sleeve.

Figure 5:
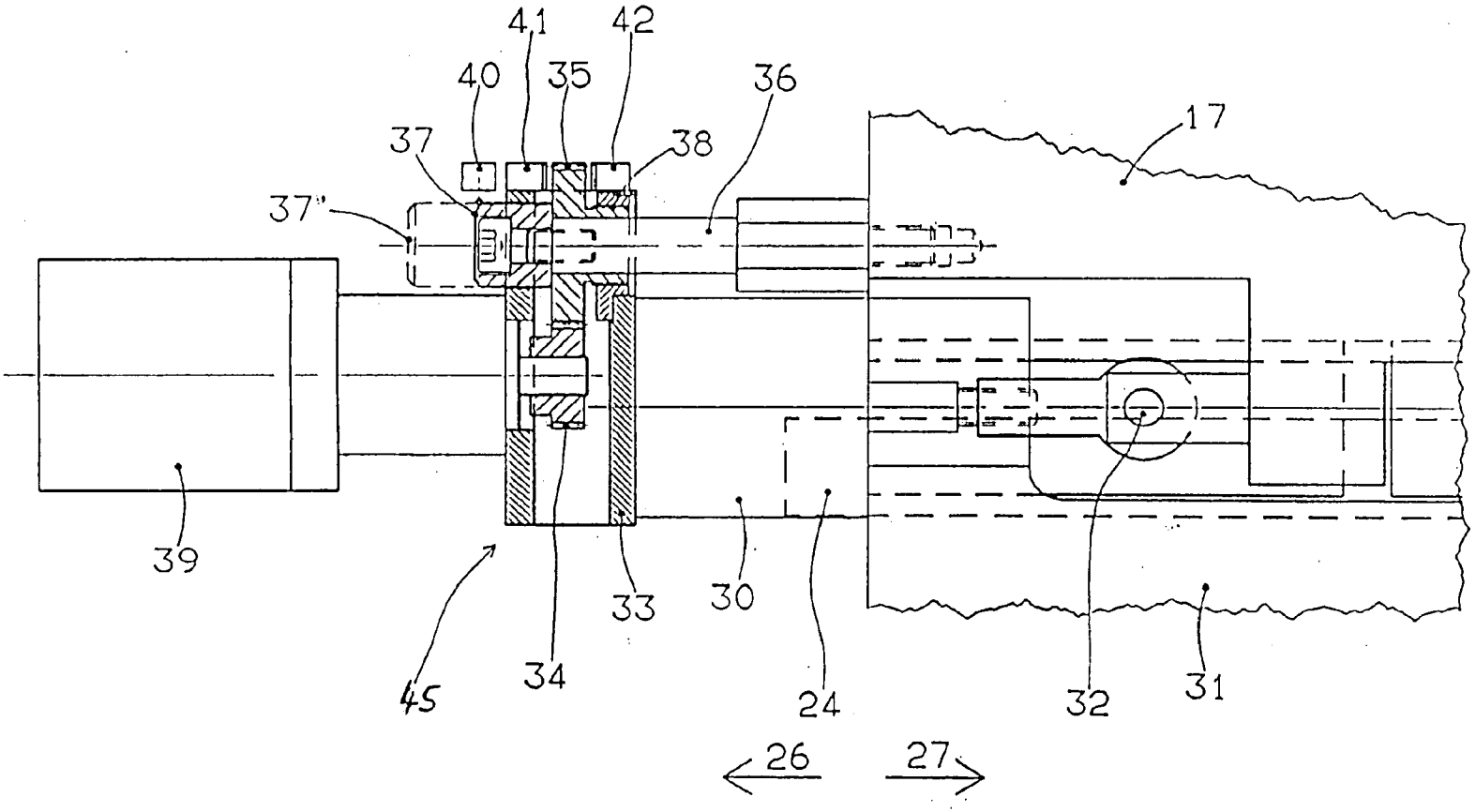
FIG. 5 is a cross-sectional view of an enlarged detail of FIG. 3 in the area of the register adjustment.
Figure 6:
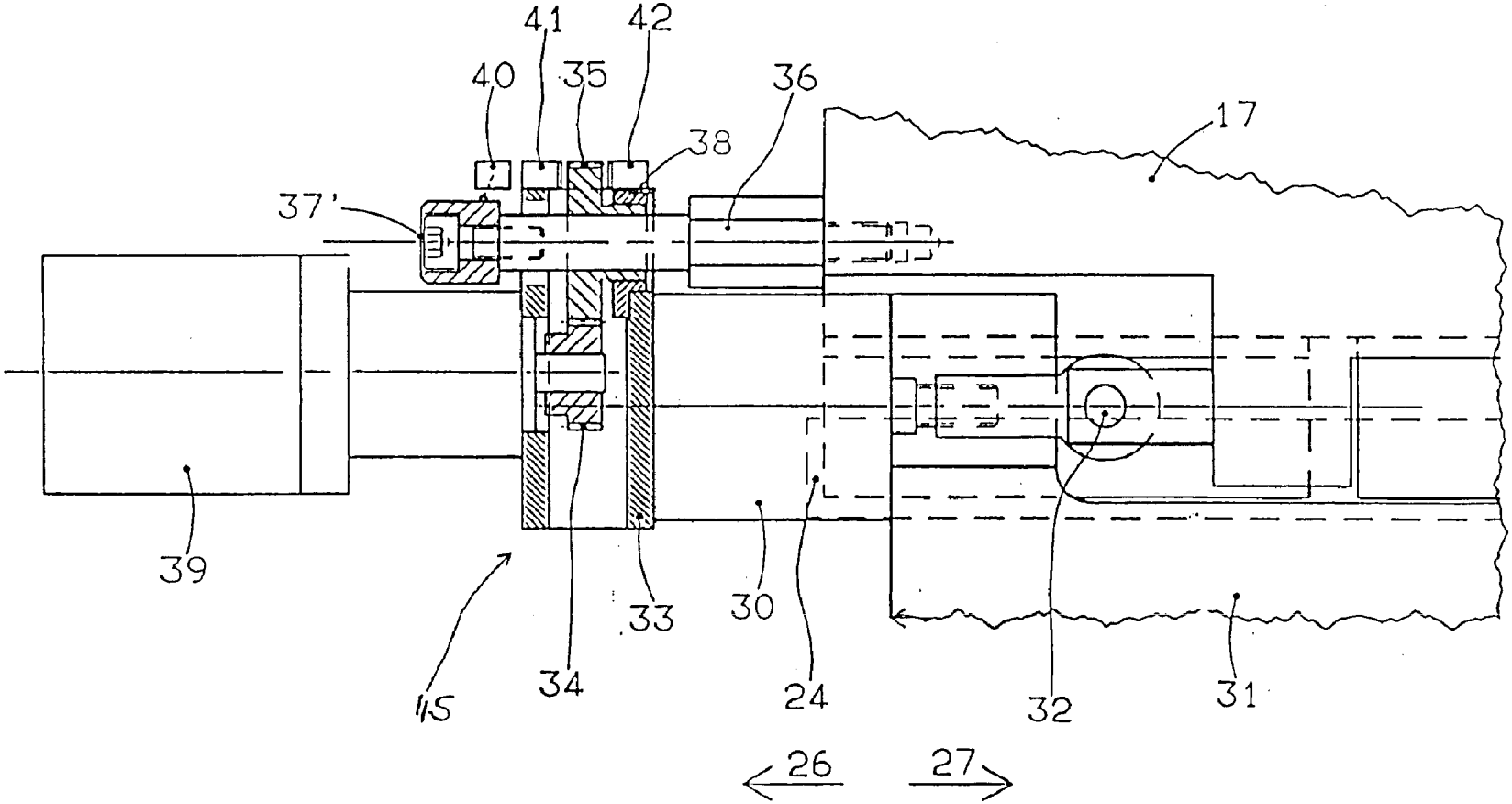
FIG. 6 is a cross-sectional view of an enlarged detail of FIG. 4 in the area of the register adjustment.

FIGS. 5 and 6 show in enlarged details of FIGS. 3 and 4, how the register-adjustment means, i.e. the device for adjusting the lateral register, of the forme cylinder 9, 10 is combined with this coupling movement. A mechanism 45, that includes a housing 33 and spur gears 34 and 35, is fixed to a pressure-medium-operated operating cylinder 30 and is supported on a stationary machine frame 31 via the latter. A pin 36 is screwed in the bearing block 17 and is supported on the spur gear 35 by its head 37. In order to implement the lateral registration, i.e. a force effect or setting pressure of the operating cylinder 30 in the direction 27 (setting or coupling direction), the operating cylinder 30 presses the bearing block 17 in the direction 27 via the pivot bearing 32 and brings the head 37 to bear on the spur gear 35 without play. This spur gear 35 is moved axially, i.e. in the direction 26 or 27, when it is being rotated by means of a thread 38, which is configured, for example, as fine thread and is arranged in a stationary manner in the housing 33. The flanks of the thread 38 are pressed against one another without play by the pressure of the operating cylinder 30 in the direction 27. Each rotation of the spur gear 35 is thus converted into an axial movement of the bearing block 17 and of the forme cylinder 9, 10 instantly and without play. These relatively small axial movements are absorbed in the bearing block 18 configured as a floating bearing. The rotational movements of the spur gear 35 are initiated by an actuating motor 39 which are directed by a controller 43 which processes the deviations of the register crosses which are registered by the scanning-optics units 15 and 16 configured as cameras.

If the deviations of the register crosses from one another are too high, for example, at the start of printing, then a relatively long displacement distance must be covered to correct the register deviations, with the result that the spur gear 35 is initially rotated at a high speed by actuating motor 39 in order to shorten the time taken by the displacement process. A high speed, a "positioning speed", of the axial movement of bearing block 17 results from this high displacement speed. With increasing rotation of spur gear 35, the lateral register is corrected, i.e. the deviations in the register crosses are reduced, with the result that the displacement distance to be covered in order to correct the register deviations becomes smaller. In this way, the rotational speed of the spur gear 35 is reduced because of the registered reduced deviations of the register crosses and because of the reduced displacement distance. The high rotational speed of the spur wheel 35 at the beginning of the correction of the lateral register, that is needed because of the large deviations in the register crosses, is thus reduced in steps as a result of the increasing improvement in the lateral register until these register deviations are finally corrected. The speed of the actuating motor 39 can thus be set to be variable and/or different.

The center position of the spur gear 35 is registered by a switch 40, and the end positions of the actuating path are registered by contactless switches 41 and 42. The spur gear 35 thus represents an adjustable stop.

In the case of the decoupling, described above, of the forme cylinder 9, 10 from the bearing block 18 configured as a floating bearing, the pneumatic cylinder 30 moves in direction 26 and the pin 36 with the head 37 moves into the positions 36' or 37', as shown in FIG. 6. Axial registration or lateral registration is thus not operational.

As an alternative, it is possible, but not shown in greater detail, to use an adjustable carriage in accordance with U.S. Pat. No. 6,502,509 instead of the stationary machine frame 31.

The apparatus is not intended to be restricted only to use on forme cylinders. It is also possible additionally to use the apparatus on transfer cylinders in order to carry out rapid cylinder exchange or rapid exchange of a blanket-cylinder sleeve arranged on the transfer cylinder.

This exemplary embodiment therefore achieves the object of combining simple, accurate axial registration with a rapid coupling movement of the cylinder, in particular of the forme or transfer cylinder. The previously set positions of the axial register remain preserved, unlike in the case of a controlled axis. A controlled axis would, of course, have to move to the previously set positions again with the required accuracy, after completion of the coupling movement, which takes time.

The variable speed for correcting the register deviations, in particular lateral register deviations, is not intended to be restricted only to an actuating motor. It is also possible to operate a controlled axis used in accordance with U.S. Pat. No. 6,502,509, for example a motor-operated spindle or a linear drive, in order to correct the linear register at variable and/or different speeds.

The invention is not limited by the embodiments described above which are presented as examples only but can be modified in various ways within the scope of protection defined by the appended patent claims.

What is claimed is:

1. An apparatus for setting the lateral register of a printing unit of a rotary press for printing a paper web, the press comprising at least one forme cylinder having a drive side, an operating side, and an axis therebetween, the apparatus comprising:

a first bearing block configured as a locating bearing and arranged on the drive side;

a second bearing block configured as a floating bearing and arranged on the operating side;

an adjustable stop;

a pressure medium operated operating cylinder displacing the first bearing block axially and for pressing the first bearing block against the adjustable stop for the purpose of lateral registration, the first bearing block being pressed against the adjustable stop by a setting pressure in a setting direction;

a controller for controlling the axial location of the adjustable stop in at least one of a closed-loop fashion and an open-loop fashion; and at least one scanning-optics unit scanning the paper web and connected to the controller.

2. The apparatus of claim 1 further comprising a pin connected to the bearing block and guided through the adjustable stop, the pin having a head which comes into contact with the stop without play as a result of the setting pressure.

3. The apparatus of claim 1, wherein the adjustable stop comprises a spur gearfixed to the pin and threaded into a stationary housing, whereby the spur gear can be moved by turning the spur gear.

4. The apparatus of claim 3 further comprising an actuating motor connected to the spur gear for rotatably driving the spur gear.

5. The apparatus of claim 1 further comprising a drive for axially displacing the first bearing block to set the lateral register, the drive displacing the first bearing block with a speed which depends on the distance of the axial displacement.

6. The apparatus of claim 5, wherein the scanning optics unit scans the web and determines the register deviations which are passed to the controller, the controller controlling the speed as a function of the register variations by at least one of a variable closed-loop control and variable open-loop control.

7. The apparatus of claim 5, wherein the speed of the axial displacement is a function of at least one of the rotational speed of the forme cylinder and the circumference of the forme cylinder.

8. The apparatus of claim 5, wherein the speed is relatively high for a relatively large axial displacement distance and the speed is relatively low for a relatively small axial displacement distance.

9. The apparatus of claim 8, wherein the speed is reduced without steps as the displacement distance becomes smaller during correction of the lateral register.

* * * * *